US006910686B2

(12) United States Patent
Awano

(10) Patent No.: US 6,910,686 B2
(45) Date of Patent: Jun. 28, 2005

(54) PAPER PROCESSING APPARATUS AND CUTTER UNIT

(75) Inventor: Hiroaki Awano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/389,926

(22) Filed: Mar. 18, 2003

(65) Prior Publication Data

US 2004/0113348 A1 Jun. 17, 2004

(30) Foreign Application Priority Data

Dec. 17, 2002 (JP) ..... 2002-364918

(51) Int. Cl.[7] ..... B65H 37/04

(52) U.S. Cl. ..... 270/37; 270/52.17; 270/58.07; 493/356; 83/934; 83/676; 412/16; 399/407; 399/488; 399/489; 399/471.2

(58) Field of Search ..... 83/56, 614, 676, 83/934, 508, 509, 488, 471.2; 270/58.07, 52.17, 37, 32; 412/16, 18; 493/340, 370, 371, 356–360; 399/407

(56) References Cited

U.S. PATENT DOCUMENTS 4,030,394 A * 6/1977 Kistner et al. ..... 83/409
4,819,021 A * 4/1989 Doery ..... 399/382
4,891,681 A * 1/1990 Fiske et al. ..... 399/385
5,377,965 A * 1/1995 Mandel et al. ..... 270/37
5,379,668 A * 1/1995 Standing ..... 83/99
6,099,225 A * 8/2000 Allen et al. ..... 412/32
6,532,856 B2 * 3/2003 Kato et al. ..... 83/934
6,692,424 B2 * 2/2004 Pasman et al. ..... 493/324
2001/0054342 A1 * 12/2001 Kato et al. ..... 83/78
2003/0160376 A1 * 8/2003 Yamada et al. ..... 270/58.07

FOREIGN PATENT DOCUMENTS

JP 11348451 A * 12/1999 ..... B42C/19/00
JP A 2000-103567 4/2000
JP A 2000-143081 5/2000
WO WO 00/18583 * 6/2000

* cited by examiner

*Primary Examiner*—Patrick Mackey
(74) *Attorney, Agent, or Firm*—Oliff & Berridge, PLC

(57) ABSTRACT

A paper processing apparatus that includes: a paper carry-in port, which is disposed at one side surface of the paper processing apparatus; a center-bound paper discharge port, which is disposed at another side surface opposite from the paper carry-in port; a center-binding compilation tray, which extends from an upper direction of the one side surface to a lower direction of the other side surface, and aligns and accommodates plural sheets of paper conveyed from the paper carry-in port; a center-binding stapler, which binds a predetermined portion of the paper stack that is accommodated and aligned; a folding knife, which folds the bound paper stack; a rotary cutter unit, which is disposed vertically above the center-binding compilation tray and cuts the folded paper using a horizontally moving blade.

29 Claims, 6 Drawing Sheets

PAPER PROCESSING APPARATUS AND CUTTER UNIT

The present disclosure relates to the subject matter contained in Japanese Patent Application No. 2002-364918 filed on Dec. 17, 2002, which is incorporated herein by reference in its entirety.

BACKGROUND OF THE INVENTION

1. Field of the Invention

The present invention relates to a paper processing apparatus that processes paper (sheets) discharged from an image forming apparatus, such as a printer or a copying machine, and in particular relates to a paper processing apparatus including a paper cutting mechanism.

2. Description of the Related Art

Many proposals have conventionally been made in regard to paper processing apparatus in which recorded paper (sheets) that is discharged from an image forming apparatus, such as a printer or a copying machine, is retrieved as a bound book. For instance, paper processing apparatus have been proposed in which paper that is discharged from an image forming apparatus and stacked is bound in a central portion thereof, the paper is bound at the bound position and folded in two, the folded paper is pressed, an end thereof is cut, and the paper is retrieved as a bound book.

FIG. 6 is view for describing a conventional paper processing apparatus. A paper processing apparatus 201 that is connected to an image forming apparatus 200 receives, at input rollers 202, paper that has been discharged from ejection rollers 230 of the image forming apparatus 200 and conveys, with conveyance rollers 203, the paper within a conveyance path 220. Using a turn roller 204 and a switching detent 205, a paper stack is accommodated at a stacker 206 after the paper passes along a U-turn conveyance path where the conveyance path is largely curved. The stacker 206 extends diagonally downward, from an upper portion of a surface (opposite surface side; left-side surface in FIG. 6) that is opposite from a paper conveyance path surface side (right-side surface in FIG. 6) including the input rollers 202 toward the paper conveyance path surface side (right-side surface in FIG. 6). The width-direction size of the accommodated paper stack is positioned by a positioning stopper 208 that is moved up and down by the rotation of a belt 207, and the center portion of the accommodated paper stack is bound by a stapler 210. Thereafter, the positioning stopper 208 moves upward, so that the center portion reaches a position of a folding blade 211.

In a folding operation, the folding blade 211 proceeds diagonally forward, from above to below, by turning on a solenoid 216, and the folding blade 211 presses the paper stack against a paper stack discharge port 209 and initiates folding. The cut paper stack is fed to pre-press rollers 212 and further conveyed downstream. Thereafter, the folding is intensified by press rollers 214, and the paper stack is conveyed to a cutting position of a slidable cutting device 213 and stopped. A cutting blade of the slidable cutting device 213 is moved from up to down, and an end of the folded paper stack is cut by a guillotine format by the cutting blade and a fixed blade. Thereafter, the cut paper stack is stacked in a discharge tray 215 as a center-bound book.

In these mechanisms, there is technology in which the cutting position is determined while the center-bound book that is to be cut is held by the press rollers 214, and the pointed cutting blade of the slidable cutting device 213 is lowered to cut the center-bound book, whereby the end of the center-bound book is precisely and cleanly cut (e.g., see JP-A-2000-143081 (pp. 5–6, FIG. 1)). There is also technology in which the paper ends are cut by paper cutting means in a state in which the bound folded paper straddles both paper cutting means, such as the slidable cutting device 213, and paper stacking means, such as the discharge tray 215, whereby the dispositional area of the device can be made smaller by only the dimension at which the paper sticks out (e.g., see JP-A-2000-103567 (pp. 3–4, FIG. 1 )).

In recent years, there has been a strong demand to miniaturize and make apparatus compact, and also to conserve the energy of apparatus from an ecological standpoint. This trend is the same with respect to post-processing apparatus of image processing apparatus. When one looks at the above-mentioned technology of JP-A-2000-143081 and JP-A-2000-103567, a slidable cutting device that employs the guillotine format is used as the cutting device, and this slidable cutting device is superior in that its cutting action is fast. However, because the guillotine format is employed, it is necessary for the stroke of the cutting blade to be large, which results in the overall apparatus becoming large. It also becomes necessary to dispose the cutting blade across the entire width of the paper, which results in an unavoidable increase in the cost of the cutting blade. Moreover, it becomes necessary for the load to be concentrated in order to cut the paper instantaneously and for the driving current and the starting current to be extremely large, so that improvements are demanded from an ecological standpoint. Furthermore, there has not been much freedom with respect to places where the cutting device can be disposed because the cutting device itself becomes larger (e.g., the discharge port must be disposed downstream of the device), and it has been difficult to provide a paper processing apparatus that is easy to use from the standpoint of the user.

SUMMARY OF THE INVENTION

The present invention has been devised in order to solve the above-described technological problems, and it is an object thereof to provide a paper processing apparatus having a paper cutting function, in which the apparatus is miniaturized and maximum electric power is little.

Another object of the invention is to provide a paper processing apparatus in which ease of use with respect to the user is improved.

In order to achieve these objects, in one aspect of the present invention, a cutting unit that cuts a paper stack by a rotating and horizontally moving round blade is disposed in a paper processing apparatus. The cutting unit can be miniaturized in comparison to the conventional sliding format (guillotine format), in order to cut the paper stack from a direction orthogonal to a conveyance direction of the paper stack. That is, the paper processing apparatus to which the invention is applied receives paper with paper receiving section, aligns and accommodates plural sheets of the received paper with paper stack accommodating section, folds the accommodated and aligned paper stack with folding section, and cuts the folded paper stack with cutting section using a horizontally moving blade.

The cutting section cuts the paper stack by rotating and horizontally moving a round blade. When the round blade is characterized by a cantilevered structure, it becomes easy to dispose, near the round blade, holding section for holding the paper stack to be cut by the cutting section. Moreover, the cutting section can move the blade at a time during which paper sheets of a predetermined number for forming a subsequently processed paper stack are being accommodated with respect to the paper stack accommodating section. Also, another aspect of the invention can be characterized by further including paper binding section for binding a center portion of the paper stack accommodated by the paper stack accommodating section, with the folding section folding the paper stack from a bound portion of the paper stack whose center portion has been bound by the paper binding section.

Another aspect of the present invention may include: folding section that stands by at a position at which an edge thereof does not project from below the accommodation surface when the paper stack is accommodated by the paper stack accommodating section, and after the paper stack has been accommodated, the edge projects upward from the accommodation surface to fold the paper stack when the paper stack is to be folded; and cutting section for cutting the paper stack folded by the folding section, the cutting section being disposed in an upper direction orthogonal to the accommodation surface.

Here, the folding section includes a knife edge that projects in the direction orthogonal to the accommodation surface from below the accommodation surface of the paper stack accommodation section to above, and the cutting section cuts an end of the paper stack pushed upward from the accommodation surface by the projection of the knife edge. Also, the folding section includes first folding rollers, which sandwich the paper stack from a center portion pushed by the knife edge, and second folding rollers, which further fold the paper stack conveyed from the first folding rollers, and the cutting section cuts the paper stack in a stack in which the paper stack is retained by the second folding rollers.

It should be noted that the cutting section can be characterized by another structure. For example, the cutting section can be disposed at a position within a space in a vertical direction of the apparatus occupied by the paper stack accommodating section and/or at a position within a space in a horizontal direction of the apparatus occupied by the paper stack accommodating section. The cutting section can also be characterized in that it cuts the paper stack folded by the folding section, from an end of the paper stack toward a direction orthogonal to a paper conveyance direction. In this instance, the cutting section includes a first blade and a second blade, and cuts the paper stack from the end of the paper stack to another end by pushing the first blade and the second blade toward the paper stack in a direction orthogonal to the paper conveyance direction.

From a standpoint of another aspect of the invention, a paper processing apparatus to which the invention is applied includes: a paper carry-in port disposed at a side surface; a paper discharge port disposed at another side surface opposite from the paper carry-in port; a compilation tray for aligning and accommodating plural sheets of the paper carried in from the paper carry-in port, the compilation tray extending from an upper direction of the one side surface to a lower direction of the other side surface; a cutter unit for cutting the folded paper, the cutter unit being disposed vertically above the compilation tray; and a tray on which is stacked the paper that has been cut by the cutter unit and discharged from the paper discharge port.

Here, the cutter unit concludes the cutting of the paper by moving the blade in one horizontal direction or concludes the cutting of the paper by reciprocally moving the blade horizontally. Moreover, the cutter unit includes a horizontally moving round blade and a fixed blade that faces the round blade and extends in the horizontal direction, and cuts the paper by rotating the round blade along the fixed blade.

Further, a paper processing apparatus to which the invention is applied includes: a paper carry-in port disposed at a side surface; a compilation tray for aligning and accommodating plural sheets of the paper carried in from the paper carry-in port; and a cutter unit for cutting the paper accommodated and center-folded at the compilation tray, wherein the cutter unit cuts the paper, at an end of a direction orthogonal to a paper conveyance direction, by moving a blade from a state in which the blade is retracted from a paper conveyance path in a direction orthogonal to the paper conveyance direction on the paper conveyance path.

The invention also makes possible a cutter unit capable of being accommodated in a paper processing apparatus in which a predetermined number of sheets of recorded paper are stacked, center-binding is conducted with respect to the stacked paper stack, the paper stack is folded from the center-bound portion, and an end of the folded paper stack is cut to generate a center-bound booklet, the cutter unit including: a fixed blade that extends along a direction orthogonal to a conveyance direction of the recorded paper when mounted to the paper processing apparatus; and a round blade that is disposed facing the fixed blade and rotates while moving in the direction in which the fixed blade extends, wherein the round blade cuts the end of the paper stack by rotating while moving in the direction orthogonal to the conveyance direction of the recorded paper.

Here, the cutting unit is configured so as to be able to be accommodated vertically above a compilation tray on which are stacked the recorded paper disposed at the paper processing apparatus with respect to the paper processing apparatus. The cutting unit further includes: moving mechanism for moving the round blade in the direction in which the fixed blade extends; and rotating mechanism for rotating the round blade in accordance with the movement of the round blade by the moving mechanism.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An embodiment of the present invention will be described below with reference to the attached drawings.

Figure 1:
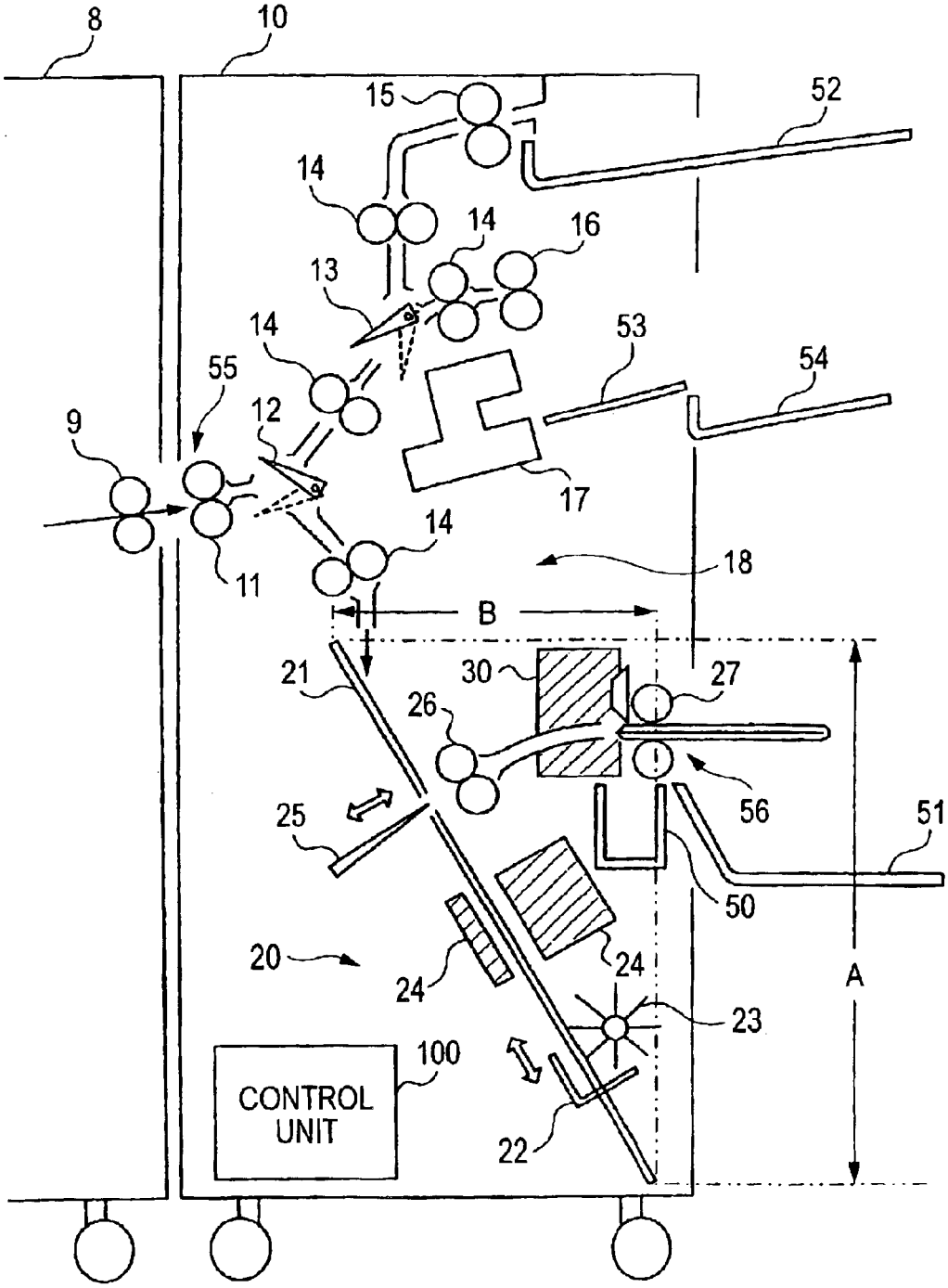
FIG. 1 is a view showing the overall structure of a paper processing apparatus to which an embodiment of the invention is applied.

FIG. 1 is a view showing the overall structure of a paper processing apparatus to which the present embodiment is applied. A paper processing apparatus 10 is connected to an image forming apparatus 8, such as a copying machine or a printer that forms a color image by electrophotography, and is used as a post-processing apparatus. The paper processing apparatus 10 includes, in addition to output for which post-processing is not to be effected and output of end-bound booklets, a small booklet creation section 20 that creates small booklets that have been bound.

The paper processing apparatus 10 includes: a paper carry-in port 55, which receives printed paper (sheets) outputted via discharge rollers 9 of the image forming apparatus 8; inlet rollers 11, which are disposed near the paper carry-in port 55 and are a pair of rollers that receive the paper; a first gate 12, which apportions the paper inputted by the inlet rollers 11 to the small booklet creation section 20 or into ordinary discharge and an end-bound booklet; a second gate 13, which apportions the conveyed paper into output for which post-processing is not to be effected or an end-bound booklet; conveyance rollers 14, which are disposed on a paper conveyance path and are pairs of rollers that convey the paper to various sections; first discharge rollers 15, which are a pair of rollers that discharge the paper as output for which post-processing is not to be effected; a tray 52, on which is stacked the paper discharged from the first discharge rollers; second discharge rollers 16, which are a pair of rollers that discharge paper for end-binding; an end-binding compilation tray 53, on which is stacked paper in order for the paper stacked thereon to be end-bound; an end-binding stapler 17, which binds the paper stacked on the end-binding compilation tray 53; and an end-bound booklet tray 54, on which are stacked end-bound booklets.

The small booklet creation section 20 includes: a center-binding compilation tray 21, on which are stacked a necessary number of paper sheets after image formation when a small booklet is created; a positioning stopper 22, which includes a positioning portion, which projects from the center-binding compilation tray 21, and moves along the center-binding compilation tray 21 in order to determine a center-binding position and a folding position; a paper alignment member 23, which is structured by a paddle that rotates in order to align paper stacked on the center-binding compilation tray 21 toward the positioning stopper 22; and a center-binding stapler 24 that binds the paper stacked on the center-binding compilation tray 21.

The small booklet creation section 20 also includes: a folding knife 25, which moves so as to project upward from below the center-binding compilation tray 21 in order to fold, from the center-binding position, the paper stack bound by the center-binding stapler 24; first folding rollers 26, which are a pair of rollers that sandwich the paper stack that has begun to be folded by the folding knife 25; second folding rollers 27, which are a pair of rollers that further intensify folding with respect to the paper stack conveyed by the first folding rollers 26 and fix the paper stack at the time of cutting; a rotary cutter unit 30, which cuts the paper sandwiched by the second folding rollers 27 while moving horizontally in a direction orthogonal to the paper conveyance direction (e.g., from an inner side (far side) of the apparatus to an outer side (near side) of the apparatus, or from the outer side (near side) of the apparatus to an inner side (far side) of the apparatus); a cuttings box 50, which collects cuttings produced by the rotary cutter unit 30; a center-bound paper discharge port 56, which is an opening for outputting the generated center-bound paper to outside of the machine; and a booklet tray 51, which is disposed near the center-bound paper discharge port 56 and on which are stacked the bound books that have been created by being cut by the rotary cutter unit 30. The small booklet creation section 20 also includes a control unit 100 that controls the entire paper processing apparatus 10. It should be noted that, instead of using the control unit 100 in the paper processing apparatus 10, it is also possible to configure the invention so that the paper processing apparatus 10 is controlled by a control unit (not illustrated) disposed in the image forming apparatus 8.

A range A shown in FIG. 1 is a space in the vertical direction of the paper processing apparatus 10 occupied by the center-binding compilation tray 21, which is one paper stack accommodating section. Range B in FIG. 1 is a space in the horizontal direction of the paper processing apparatus 10 occupied by the center-binding compilation tray 21. In a case where a conventional guillotine-format (sliding) cutter is employed, it is necessary to increase the stroke in order to cut, and it has been difficult to position the cutting section within these spaces. However, in the present embodiment, there is a characteristic in that the rotary cutter unit 30, which is one cutting section, is positioned within the vertical-direction space and the horizontal-direction space. Although the space occupied by the center-binding compilation unit 21 is determined by the length of the paper, it becomes possible to prevent the apparatus from becoming large by disposing the rotary cutter unit 30 inside of these spaces.

When seen horizontally, the center-binding compilation tray 21 is disposed beneath the end-binding stapler 17 so as to be superposed with the end-binding stapler 17, prevents enlargement of the width of the paper processing apparatus 10, and forms a space 18 between the center-binding compilation tray 21 and the end-binding stapler 17. However, it is possible to virtually eliminate the space 18 depending on the position of the end-binding stapler 17 and the disposition of the center-binding compilation tray 21. The end-binding stapler 17 adopts a format in which a binding action is conducted while unbound ends of the paper are sent to the outside of the paper processing apparatus 10, and is suited for keeping the width of the apparatus small in comparison to a case where a format is adopted in which the binding of the paper, including unbound ends, is conducted inside the apparatus. Generally, it is preferable for the discharge tray to be at a height that can be reached by the hand of the user without the user having to bend his/her back, and the tray 52 and the end-bound booklet tray 54 are also positioned using the ease of the user as a reference. Accordingly, in the paper processing apparatus 10 including both functions of center-binding and end-binding, although the space 18 is present, the area of the space 18 is restricted.

By adopting the end-binding stapler 17 of this format, the height of the rotary cutter unit 30 is low even if the width of the range B is narrow. Thus, the range in which the rotary cutter unit 30 can be disposed in the space 18 is wide, and the freedom with which the rotary cutter unit 30 can be disposed is great. Also, by disposing the rotary cutter unit 30 adjacent to the center-binding compilation tray 21, the invention can also be structured so that the rotary cutter unit 30 fits in the range B. Moreover, as another structure, it is possible to dispose the rotary cutter unit 30 above the inside of the space 18 and gain height for the booklet tray 51. In this case, because plural booklets are heavy, the user can retrieve booklets from the booklet tray 51 with little burden.

Next, the action of the paper processing apparatus shown in FIG. 1 will be described. Printed (recorded) paper discharged from the discharge rollers 9 of the image forming apparatus 8 enters the paper processing apparatus 10 from the paper carry-in port 55, is conveyed by the inlet rollers 11, and is apportioned to the small booklet creation section 20 or to other processing sections by the switching operation of the first gate 12 based on a control from the control unit 100. For simply discharged paper or in the creation of end-bound booklets, the first gate 12 pivots downward (counter-clockwise; the broken line indicated in FIG. 1), and the paper is pushed upward and is conveyed further upward by the conveyance rollers 14. In the case of simply discharged paper, the second gate 13 pivots downward (counter-clockwise; the broken line indicated in FIG. 1), and the paper passes through the conveyance rollers 14 and is discharged to the tray 52 by the first discharge rollers 15. In the case of creating end-bound booklets, the second gate 13 pivots upward (clockwise; the solid line indicated in FIG. 1), and the paper passes through the conveyance rollers 14 and is discharged to the end-binding compilation tray 53 from the second discharge rollers 16. Thereafter, the end of the paper stack is bound by the end-binding stapler 17, and the paper stack is discharged to the end-bound booklet tray 54 from the center-bound paper discharge port.

In the case of creating a center-bound small booklet, the first gate 12 pivots upward (clockwise; the solid line indicated in FIG. 1), and the paper is pushed downward, passes through the conveyance rollers 14, and is stacked on the center-binding compilation tray 21. For instance, sheets of a number (e.g., five sheets, ten sheets, or fifteen sheets) that has been set at the image forming apparatus 8 are stacked on the center-binding compilation tray 21. At this time, the positioning stopper 22 is moved by a mechanism described later, so that the center portion of the paper reaches a position at which the center portion of the paper is stapled by the center-binding stapler 24, and stopped. Moreover, at this time, the paper alignment member 23 pivots toward the positioning stopper 22, pushes the stacked paper against the positioning stopper 22, and aids paper alignment.

Figure 6:
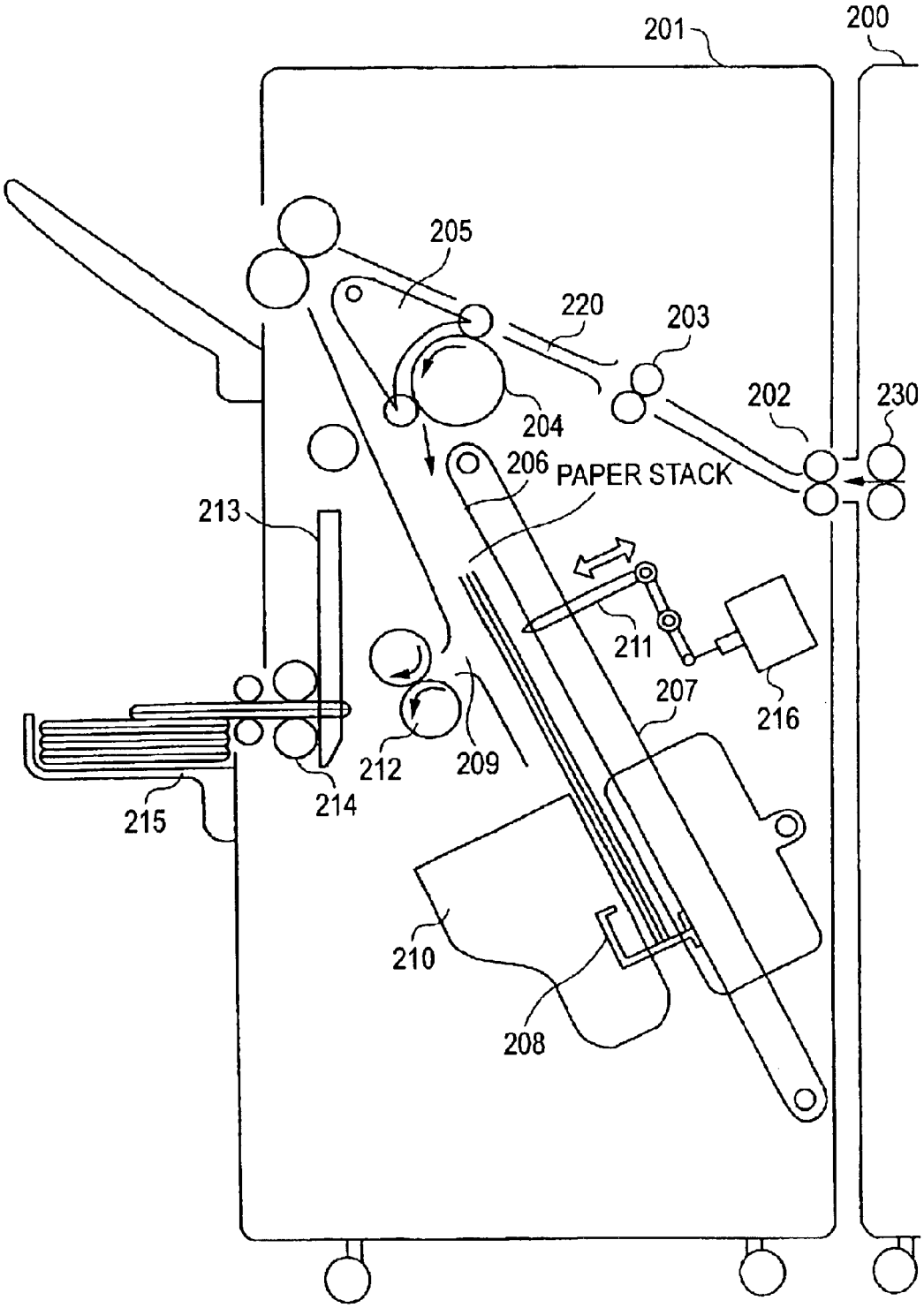
FIG. 6 is a view for describing a conventional paper processing apparatus.

In the paper processing apparatus 10 including the paper carry-in port 55 disposed at one side surface of the paper processing apparatus 10 and the center-bound paper discharge port 56 disposed at another side surface opposite from the side surface at which the paper carry-in port 55 is disposed, the center-binding compilation tray 21 to which the present embodiment is applied extends from above from the one side surface to below the other side surface. That is, in the example shown in FIG. 1, the upstream side of paper conveyance is at the left side, and the downstream side is at the right side, and the center-bound paper discharge tray 21 extends from the upper left to the lower right. Thus, it is not necessary to configure the conveyance path in a large U-turn in order to convey the paper from the paper carry-in port 55 to the center-binding compilation tray 21, and the paper path can be simplified in comparison to the conventional technology shown in FIG. 6. Thus, the rotary cutter unit 30 can be disposed vertically above the center-binding compilation tray 21.

After the paper sheets of a predetermined number have been stacked on the center-binding compilation tray 21, binding is implemented with respect to a predetermined portion (e.g., the center portion) of the paper by the center-binding stapler 24. Next, the center-bound paper stack is moved by an upward movement of the positioning stopper 22 so that a folding portion (e.g., the center portion of the paper) of the paper coincides with a position of the edge of the folding knife 25. It should be noted that the folding knife 25 is structured so that the edge of the folding knife 25 is retracted below the center-binding compilation tray 21 and does not appear at the surface of the center-binding compilation tray 21 at the stage where the paper is stacked on the center-binding compilation tray 21, at the stage of center-binding by the center-binding stapler 24, and at the stage of paper conveyance after the center-binding.

After the folding position of the paper stack has been moved to the position coinciding with the edge of the folding knife 25, the folding knife 25 is pushed upward from below by a mechanism described later. That is, the folding knife 25 is disposed in an upward direction orthogonal to an accommodation surface of the center-binding compilation tray 21, and the edge abuts against the paper stack. The edge is further pushed upward, whereby the paper stack is lifted up and pushed into the first folding rollers 26. The folding knife 25 is structured so that the paper stack is moved to a position at which the paper stack is sufficiently fed into the first folding rollers 26. In this manner, the paper stack, to which a first stage folding portion has been given by the first folding rollers 26, is conveyed to the second folding rollers 27, where sufficient folding is implemented by a load from the second folding rollers 27. In this manner, folding is completed by the paper stack passing through the second folding rollers 27.

Here, the second folding rollers 27 are in a stopped state at the point in time they receive the conveyance of the paper stack from the first folding rollers 26. The second folding rollers 27 begin rotating and determine the feeding amount of the paper stack at a timing when it is expected that the paper stack will sufficiently abut against the second folding rollers 27. The position of the paper stack desired to be cut is moved, in correspondence to the size of the booklet that is desired to be finally obtained, to a position at which the paper stack is to be cut by the rotary cutter unit 30, the second folding rollers 27 are stopped, and the paper stack is fixed by the second folding rollers 27. Thereafter, the rotary cutter unit 30 moves the cutting blade horizontally to cut off the end of the paper stack. Thereafter, the second folding rollers 27 again rotate, and the cut paper stack is outputted onto the booklet tray 51 as a bound booklet from the center-bound paper discharge port 56.

Figure 2:
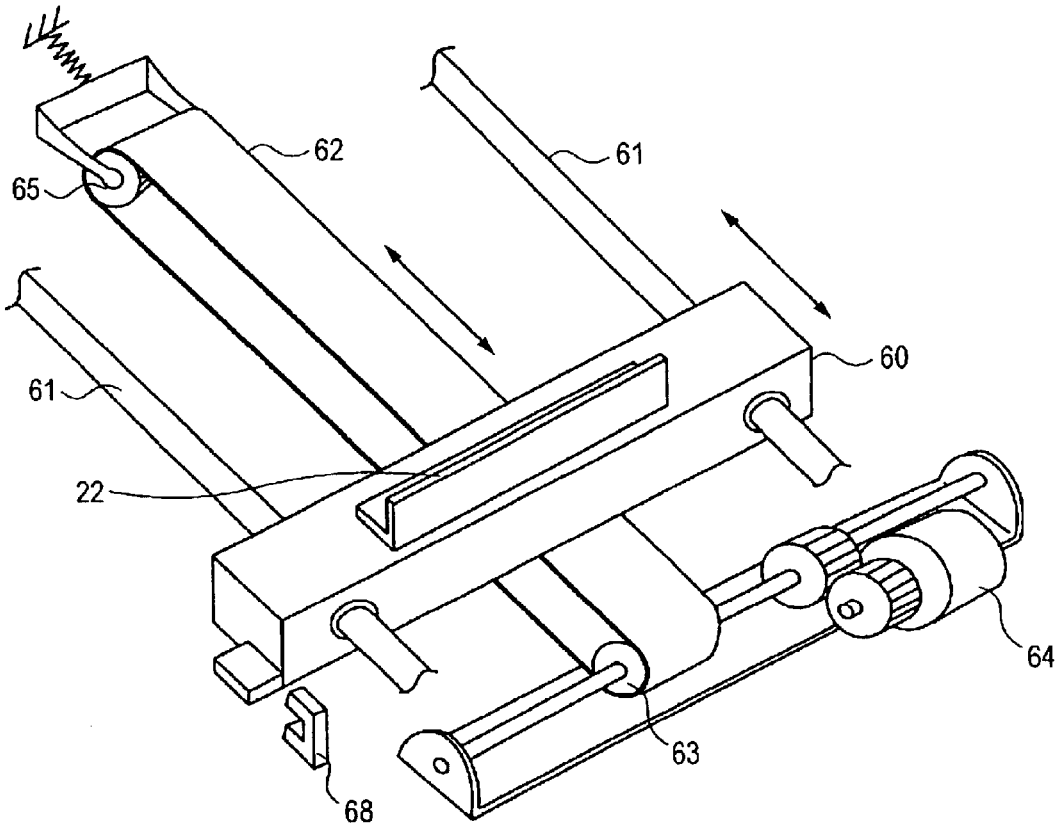
FIG. 2 is a view for describing an operating mechanism of a positioning stopper.

FIG. 2 is a view for describing an operating mechanism of the positioning stopper 22. The operating mechanism includes: a carriage 60, which fixes the positioning stopper 22; guide shafts 61, on which the carriage 60 slides and which guide the movement of the carriage 60; a belt 62, which is connected to the carriage 60 and causes the carriage 60 to slide by the belt 62 rotating; a drive roller 63, which drives the belt 62; a motor 64, which repeats normal rotation and reverse rotation as a drive source for the drive roller 63; a tension roller 65, which applies constant tension to the belt 62; and a home position sensor 68, which is a sensor for determining an initial position of the carriage 60.

On the basis of control of a control unit (not illustrated), the motor 64 rotates from a state in which positioning has been effected by the home position sensor 68, whereby a driving force is transmitted from the motor 64 via a gear and the drive roller 63 rotates clockwise and counter-clockwise. The belt 62 rotates in one direction and the opposite direction due to the rotation of the drive roller 63, and the carriage 60 is guided by and moves along the guide shafts 61 in accordance with the rotation of the belt 62. The positioning stopper 22 reciprocatingly moves parallel to the center-binding compilation tray 21 due to the movement of the carriage 60. The positioning stopper 22 stops at, for example, a predetermined position that has been preset as a home position. In this state, the paper conveyed from the paper carry-in port 55 is positioned at a position at which it is center-bound by the center-binding stapler 24. Thereafter, the motor 64 rotates, causing the positioning stopper 22 to move and stop after it has moved a predetermined distance, so that the center of the center-bound paper (i.e., the center-bound portion) coincides with the position at which the center-bound paper is folded by the folding knife 25. As a result of these operations, the positioning at the center-binding position and the positioning at the folding position of the paper stacked on the center-binding compilation tray 21 are conducted.

Figure 3A:
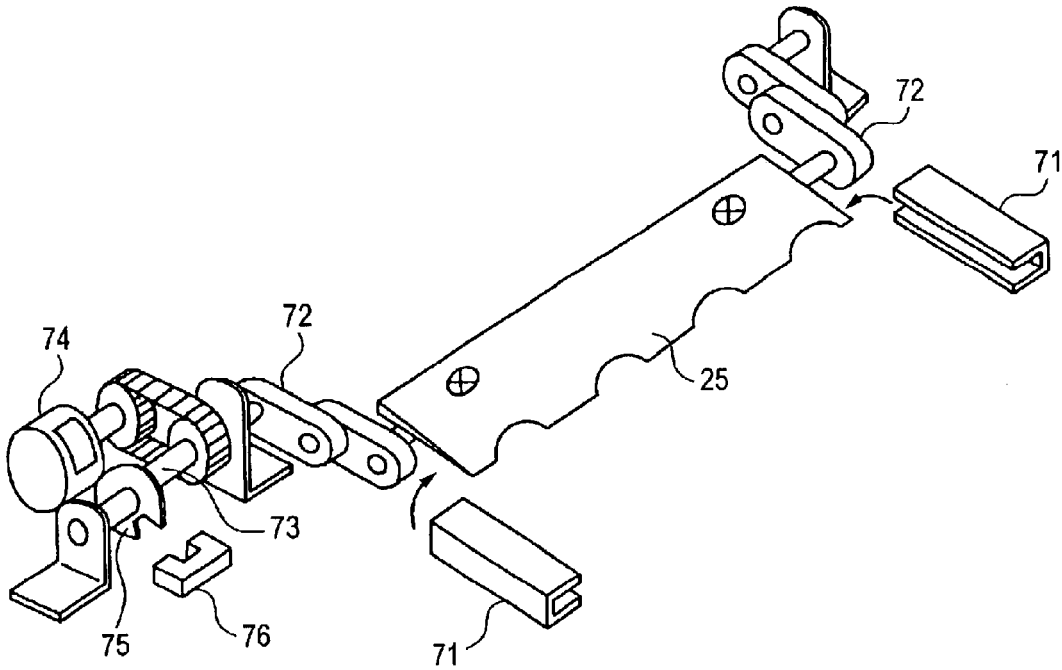
FIGS. 3A and 3B are views for describing an operating mechanism of a folding knife.
Figure 3B:
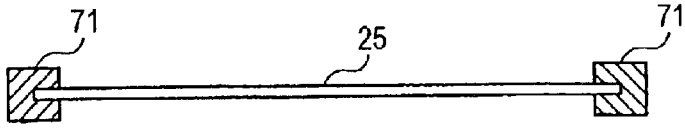

FIGS. 3A and 3B are views for describing an operating mechanism of the folding knife 25. The operating mechanism shown in FIG. 3A includes: guides 71, which are disposed at both sides of the folding knife 25 and guide the advancement and retraction (projection and recession) of the folding knife 25; cranks 72, which are disposed at both sides of the folding knife 25 and effect the projection and recession of the folding knife 25; a crank rotating shaft 73, which causes the cranks 72 to rotate; a motor 74, which provides a driving force to the crank rotating shaft 73; an encoder 75, which is disposed at the crank rotating shaft 73 and controls the advancement and retraction positions of the folding knife 25; and a sensor 76, which sends information outputted from the encoder 75 to the control unit 100 in order to control the movement of the motor 74. As illustrated in FIG. 3B, both ends of the folding knife 25 are retained by the guides 71 and structured so that the folding knife 25 can be advanced and retracted smoothly.

Figure 4A:
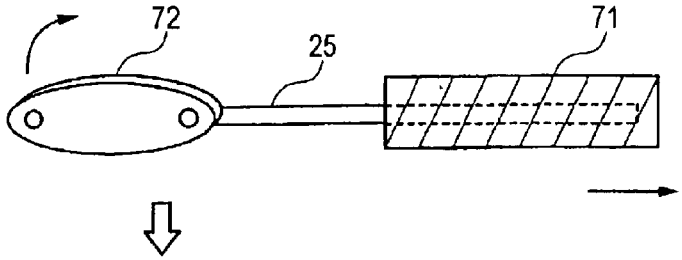
FIGS. 4A to 4E are views for describing procession and retraction of the folding knife.
Figure 4B:
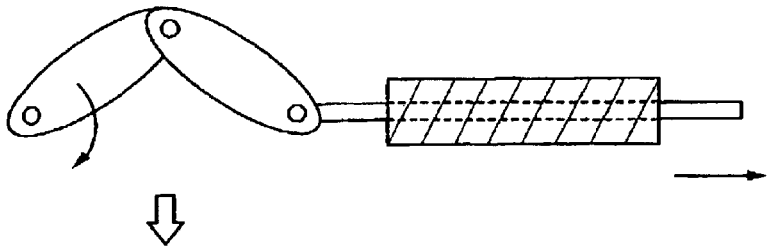
Figure 4C:
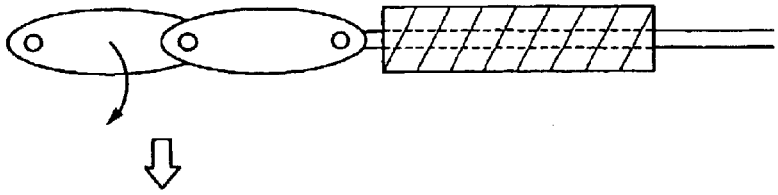

FIGS. 4A to 4E are views for describing the advancement and retraction of the folding knife 25. In FIG. 4A, the folding knife 25 is in a standby state in which it is retracted from the center-binding compilation tray 21, so that it does not obstruct the stacking of the paper by the center-binding compilation tray 21. After the printed paper of the sheet number for creating a booklet has been stacked, it is center-bound by the center-binding stapler 24, and the folding position of the paper (e.g., the center portion) is made to coincide with the position of the folding knife 25 by the positioning stopper 22. The motor 74 is made to operate on the basis of a signal from the control unit 100 according to this timing, and the cranks 72 rotates due to the rotation of the crank rotating shaft 73. The folding knife 25 that is guided along the guides 71 begins moving, due to the rotation of the cranks 72, in the direction in which it emerges from the center-binding compilation tray 21 (right direction in FIG. 4), and then proceeds to the state of FIG. 4C via the state of FIG. 4B. In the state of FIG. 4B, the paper stack begins to be lifted up, and in the state of FIG. 4C, the folding knife 25 is fed to a position at which the paper stack is pressed by the first folding rollers 26, and folding of the paper stack is implemented as an initial stage.

Figure 4D:
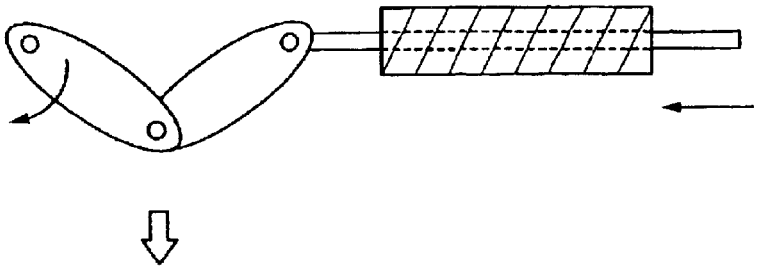
Figure 4E:
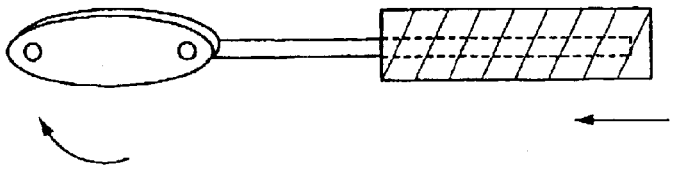

Thereafter, the motor 74 rotates further, and the folding knife begins withdrawing due to the rotation of the cranks 72, as shown in FIG. 4D. Thereafter, when the folding knife 25 has withdrawn to the withdrawn position shown in FIG. 4E, the state of the encoder 72 is detected by the sensor 76, and the control unit 100 stops the operation of the motor 74 and causes the folding knife 25 to stand by until the next folding processing.

In the present embodiment, the folding knife 25 emerges from diagonally downward to diagonally upward, i.e., from vertically below the center-binding compilation tray 21 to vertically above, and is structured so that folding is implemented by lifting up the paper stack. Thus, the paper stack is not misaligned when folding is initiated, and it becomes possible to conduct folding in a state in which high precision is maintained. By implementing folding from downward to upward, the rotary cutter unit 30, which constitutes the step after folding, can be disposed vertically above the center-binding compilation tray 21. By disposing the rotary cutter unit 30 above the center-binding compilation tray 21, it becomes possible to dispose the height of the center-bound paper discharge port 56 at a relatively high position with respect to the apparatus, and it becomes possible to improve operability by the user when the booklet is retrieved from the booklet tray 51.

Next, the rotary cutter unit 30 will be described.

Figure 5A:
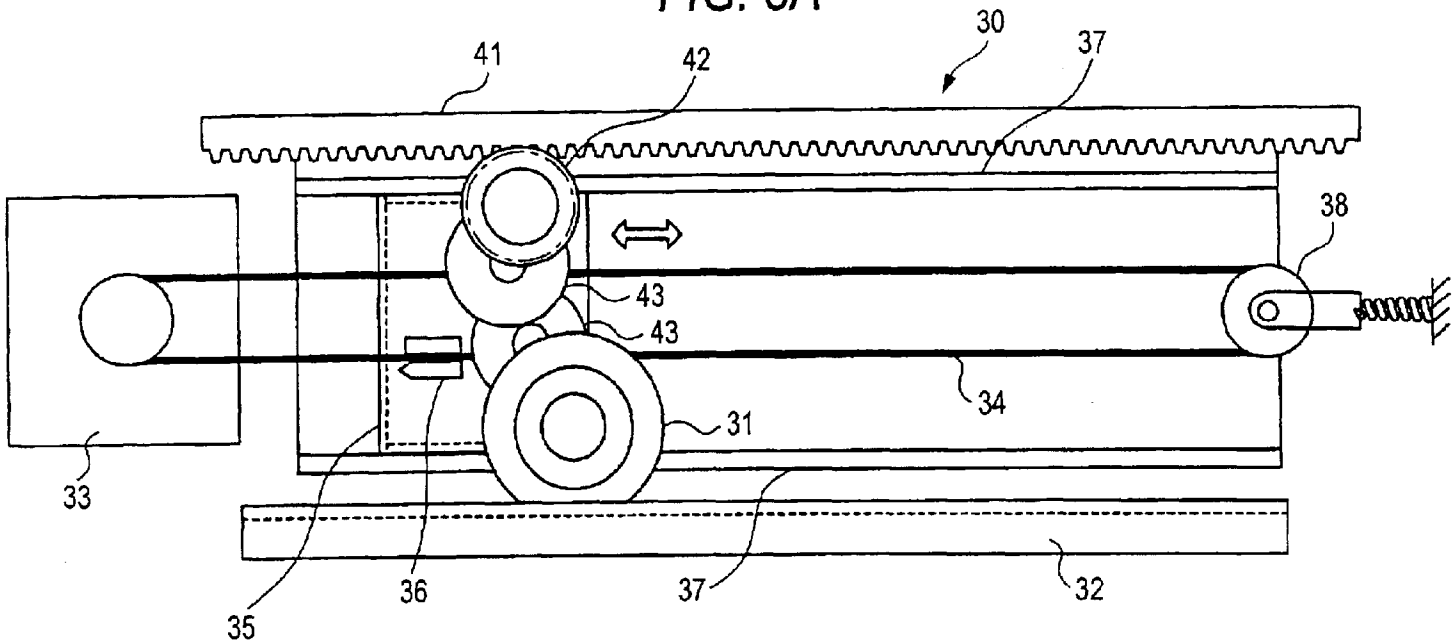
FIGS. 5A and 5B are views for describing the structure of a rotary cutter unit to which the embodiment of the invention is applied.
Figure 5B:
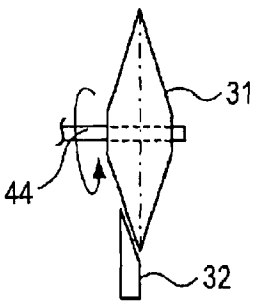

FIGS. 5A and 5B are views for describing the structure of the rotary cutter unit 30 to which the present embodiment is applied. FIG. 5A shows the structure of the rotary cutter unit 30 seen from a side surface of the apparatus, and FIG. 5B shows the state of a blade. As shown in FIG. 5A, the rotary cutter unit 30 to which the present embodiment is applied includes: a round blade 31, which moves horizontally while rotating to cut the paper stack; a fixed blade 32, which is disposed facing the round blade 31 and extends across a direction orthogonal to the conveyance direction of the recorded paper; a motor 33, which is a driving source that causes the round blade 31 to move; a belt 34, which rotates due to the motor 33; a carrier 35, which retains the round blade 31 and the like and moves; a belt fixer 36, which fixes the belt 34 to the carrier 35; guide shafts 37, which guide the movement of the carrier 35; and a tensioner 38, which pulls the belt 34 by a spring or the like in order to hold the belt 34 at a constant tension.

A rack 41, which extends across the moving direction of the round blade 31, is disposed as a mechanism for moving the round blade 31. At the carrier 35 are included a pinion 42, which is disposed facing the rack 41 and rotates due to the movement of the carrier 35, and one or several gears 43 (two in FIG. 5A), which join with a gear of the pinion 42 and transmit a rotational force to the round blade 31 at a predetermined speed ratio.

As shown in FIG. 5B, the round blade 31 contacts the fixed blade 32. The rotation of the round blade 31 is implemented by a cantilevered shaft 44. In this manner, there is no conventional guillotine format, and because the round blade 31 has a cantilevered structured resulting from the cantilevered shaft 44, it becomes possible to dispose the second folding rollers 27 opposite from the cantilevered shaft 44 (e.g., near the round blade 31), even in a case where the round blade 31 that moves horizontally is used.

Next, the operation of the rotary cutter unit 30 will be described using FIGS. 5A and 5B. The paper stack, which has begun to be folded by the first folding rollers 26 shown in FIG. 1 and whose folding has been intensified by the second folding rollers 27, is conveyed by the rotation of the second folding rollers 27 under the control of the control unit 100 so that the cutting portion of the paper stack reaches a position at which the cutting portion is to be cut by the rotary cutter unit 30. As the paper stack is conveyed to the cutting position, the rotary cutter unit 30 is at an end in the direction orthogonal to the paper conveyance direction, and is in a state in which it has been retracted to a position at which it does not obstruct the conveyance of the paper stack.

Thereafter, in a state in which the paper stack has been fixed by the second folding rollers 27, the motor 33 rotates due to an instruction from the control unit 100. The belt 34 moves due to the rotation of the motor 34, and the carrier 35 moves horizontally in the direction orthogonal to the paper conveyance direction. The round blade 31 moves horizontally in accordance with the movement of the carrier 35, and the horizontally moving pinion 42 rotates due to the rack 41, and the round blade 31 moves via the gears 43. That is, the round blade 31 moves horizontally while rotating in accordance with the rotation of the motor 33.

Due to this movement, the round blade 31 contacts the end of the paper stack fixed by the second folding rollers 27 and continues moving horizontally in the direction orthogonal to the paper conveyance direction, whereby the cutting of the paper stack is implemented by the round blade 31 and the fixed blade 32. That is, the round blade 31, which is a moving blade, is successively pushed from an end of the paper stack in the direction orthogonal to the paper conveyance direction to cut the end in the direction orthogonal to the paper conveyance direction. The motor 33 rotates in reverse due to a signal from the control unit 100, at a predetermined timing after this horizontal movement in one direction continues and the cutting of the paper stack has been concluded. Due to the reverse rotation of the motor 33, the round blade 31 horizontally moves in the opposite direction, and prepares for the next cutting by stopping at the point in time when it has reached the initial standby position.

It should be noted that, depending on the cutting method, the paper processing apparatus 10 can also be configured so that horizontal movement in the opposite direction is added, i.e., so that cutting is completed by reciprocal movement, without all of the cutting being completed by the round blade 31 only moving horizontally in one direction. The invention can also be configured so that cutting is completed at the time one booklet is created by repeating the reciprocal movement several times. By dispersing the cutting operation in this manner, it becomes possible to reduce driving power in comparison to the conventional guillotine format, and starting power and the like can be largely reduced.

In this manner, the rotary cutter unit 30 cuts the paper stack using the horizontally moving round blade 31, and can make the height of the unit extremely smaller in comparison to the conventional guillotine format. For instance, in the conventional sliding format, a height of about 440 mm was necessary for the cutting stroke of the moving blade. However, according to the present embodiment, it becomes possible to form the rotary cutter unit 30 at a height of about 140 mm. As a result, there become fewer constraints in terms of space, and it becomes possible, for example, to dispose the rotary cutter unit 30 vertically above the center-binding compilation tray 21.

Moreover, because the horizontally moving round blade 31 is used in the rotary cutter unit 30, starting power and driving power can be reduced in comparison to the conventional sliding format. For example, in the conventional sliding format, a starting power current of 12.5 A and a driving power current of 5 A were necessary. However, according to the rotary cutter unit 30 to which the present embodiment is applied, the starting power current and the driving power current can be as low as about 7.5 A and 2.5 A, respectively.

It should be noted that, in the rotary cutter format in which the paper stack is cut using the horizontally moving round blade 31, it is necessary to move the round blade 31 in the direction orthogonal to the paper conveyance direction, e.g. an A4 short hand width. For this reason, in contrast to the conventional sliding format (guillotine format) in which only the thickness of the paper stack became the cutting distance, the rotary cutter format is not suited for completing the cutting instantaneously with one operation. However, in order to stack the recorded paper of plural sheets on the center-binding compilation tray 21, it generally takes the time for the number of sheets of the recorded paper. Accordingly, it becomes possible to complete the cutting using the stacking time and in a state in which there is sufficient time to spare, even when the rotary cutter format is adopted.

As a modification of the present embodiment, the paper processing apparatus 10 can be structured so that a long first blade and second blade are used in place of the round blade 31 and pressed in the direction orthogonal to the paper conveyance direction, from one end of the paper stack to the other end, whereby the paper stack is successively cut from one end of the paper stack. Even in a case where the paper processing apparatus 10 is configured in this manner, the apparatus can be miniaturized in comparison to the conventional guillotine format (sliding format).

As described in detail above, according to the present embodiment, the paper stack that is folded by the folding knife 25, the first folding rollers 26, and the second rollers 27, which are folding section, is cut by cutting section (the rotary cutter unit 30) using the round blade 31 that moves horizontally while rotating. Thus, the paper processing apparatus 10 can be made compact, and starting power and the like can be reduced in comparison to a case where the conventional sliding format (guillotine format) is used. Also, by configuring the invention so that the folding knife 25 projects upward from below when the folding is implemented, it becomes possible to dispose the rotary cutter unit 30 in an upper direction orthogonal to the center-binding compilation tray 21, and the center-bound paper discharge port 56 can be disposed at an upper direction of the paper processing apparatus 10. As a result, the ease of use by the user can be improved.

In this manner, according to the invention, in a paper processing apparatus having a paper cutting function, the apparatus can be miniaturized and maximum electric power can be reduced.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A paper processing apparatus, comprising:

a paper receiving section for receiving paper;

a paper stack accommodating section for aligning and accommodating a plurality of the paper received by the paper receiving section;

a folding section for folding a paper stack accommodated and aligned by the paper stack accommodating section; and a cutting section for cutting the paper stack folded by the folding section using a horizontally moving blade.

2. The paper processing apparatus as claimed in claim 1, wherein the cutting section cuts the paper stack by horizontally moving a rotating round blade.

3. The paper processing apparatus as claimed in claim 2, wherein the rotating round blade of the cutting section has a cantilevered structure.

4. The paper processing apparatus as claimed in claim 1, further comprising:

a holding section for holding the paper stack to be cut by the cutting section, the holding section being disposed in a vicinity of the rotating round blade of the cutting section.

5. The paper processing apparatus as claimed in claim 1, wherein the cutting section moves the rotating round blade at a time during which paper sheets of a predetermined number for forming a subsequently processed paper stack are being accommodated with respect to the paper stack accommodating section.

6. The paper processing apparatus as claimed in claim 1, further comprising:

a paper binding section for binding a center portion of the paper stack accommodated by the paper stack accommodating section, wherein the folding section folds the paper stack from a bound portion of the paper stack whose center portion has been bound by the paper binding section.

7. The paper processing apparatus as claimed in claim 6, wherein the folding section and the paper binding section are integrated with the paper stack accommodating section.

8. The paper processing apparatus as claimed in claim 1, wherein the plurality of sheets are cut in a single operation.

9. The paper processing apparatus as claimed in claim 1, wherein the folding section is integrated with the paper stack accommodating section.

10. A paper processing apparatus, comprising:

a paper receiving section for receiving paper;

a paper stack accommodating section for aligning a plurality of sheets of the paper received by the paper receiving section and accommodating a paper stack on an accommodation surface;

a folding section that stands by at a position at which an edge thereof does not project from below the accommodation surface when the paper stack is accommodated at the paper stack accommodating section, and after the paper stack has been accommodated, the edge projects upward from the accommodation surface to fold the paper stack when the paper stack is to be folded; and a cutting section for cutting the paper stack folded by the folding section, the cutting section being disposed in an upper direction orthogonal to the accommodation surface, wherein the folding section includes a knife edge that projects in the direction orthogonal to the accommodation surface from below the accommodation surface of the paper stack accommodation section to above, the cutting section cuts an end of the paper stack pushed upward from the accommodation surface by the projection of the knife edge, the folding section includes first folding rollers, which sandwich the paper stack from a center portion pushed by the knife edge, and second folding rollers that form a nip, which further fold the paper stack conveyed from the first folding rollers, and the cutting section cuts the paper stack in a stack in which the paper stack is retained by the nip of the second folding rollers.

11. The paper processing apparatus as claimed in claim 10, wherein the cutting section includes a round blade, which moves horizontally while rotating, and a fixed blade, which is disposed facing the round blade and includes a blade edge that extends in a horizontal direction.

12. The paper processing apparatus as claimed in claim 10, wherein the folding section is integrated with the paper stack accommodating section.

13. A paper processing apparatus, comprising:

a paper carry-in port disposed at a one side surface;

a paper discharge port disposed at an another side surface opposite of the one side surface where the paper carry-in port is disposed;

a compilation tray for aligning and accommodating a plurality of sheets of the paper carried in from the paper carry-in port, the compilation tray extending from an upper direction of the one side surface to a lower direction of the another side surface;

a cutter unit for cutting the paper, the cutter unit being disposed vertically above the compilation tray; and a tray on which is stacked the paper that has been cut by the cutter unit and discharged from the paper discharge port, wherein the cutter unit cuts the paper using a horizontally moving blade.

14. The paper processing apparatus as claimed in claim 13, wherein the cutter unit concludes the cutting of the paper by moving the blade in one horizontal direction.

15. The paper processing apparatus as claimed in claim 13, wherein the cutter unit concludes the cutting of the paper by reciprocally moving the blade horizontally.

16. The paper processing apparatus as claimed in claim 13, wherein the cutter unit includes a horizontally moving round blade and a fixed blade that faces the round blade and extends in the horizontal direction, and cuts the paper by moving the round blade along the fixed blade.

17. The paper processing apparatus as claimed in claim 13, further comprising:

a stapler for binding a predetermined portion of the paper stack accommodated and aligned at the compilation tray, and a folding knife for folding the paper stack bound by the stapler.

18. The paper processing apparatus as claimed in claim 17, wherein the stapler and the folding knife are integrated with the compilation tray.

19. A paper processing apparatus comprising:

a paper carry-in port disposed at a one side surface;

a compilation tray for aligning and accommodating a plurality of sheets of paper carried in from the paper carry-in port; and a cutter unit for cutting the paper accommodated at the compilation tray, wherein the cutter unit cuts the paper, by moving a blade from a position, in which the blade is retracted from a paper conveyance path in a first direction orthogonal to the paper conveyance direction and parallel to a paper conveyance plane, in a second direction opposite to the first direction.

20. The paper processing apparatus as claimed in claim 19, wherein the blade of the cutting unit is a round blade that rotates while moving.

21. The paper processing apparatus as claimed in claim 19, further comprising:

a stapler for binding the plurality of sheets of the paper accommodated on the compilation tray; and a folding knife for initiating center-folding with respect to the plurality of sheets of the paper bound by the stapler.

22. The paper processing apparatus as claimed in claim 21, wherein the stapler and the folding knife are integrated with the compilation tray.

23. A paper processing apparatus comprising:

a paper receiving section for receiving paper;

a paper stack accommodating section for aligning and accommodating a plurality of sheets of the paper received by the paper receiving section; and a cutting section for cutting a paper stack accommodated and aligned by the paper stack accommodating section, wherein the cutting section is disposed in a space between two horizontal planes, each of which terminates at an upper or lower side of the paper stack accommodating section, and wherein the cutting section is disposed in a space between two vertical planes, each of which terminates at the upper and lower side of the paper stack accommodating section.

24. A paper processing apparatus, comprising:

a paper receiving section for receiving paper;

a paper stack accommodating section for aligning and accommodating a plurality of sheets of the paper received by the paper receiving section;

a folding section for folding a paper stack accommodated and aligned by the paper stack accommodating section; and a cutting section for cutting, from an end of the paper stack toward a direction orthogonal to a paper conveyance direction, the paper stack folded by the folding section.

25. The paper processing apparatus as claimed in claim 24, wherein the cutting section includes a first blade and a second blade, and cuts the paper stack from the end of the paper stack to another end by pushing the first blade and the second blade toward the paper stack in a direction orthogonal to the paper conveyance direction.

26. The paper processing apparatus as claimed in claim 24, wherein the folding section is integrated with the paper stack accommodating section.

27. A cutter unit capable of being accommodated in a paper processing apparatus in which a predetermined number of sheets of recorded paper are stacked, center-binding is conducted with respect to a stacked paper stack, the paper stack is folded from a center-bound portion, and an end of the folded paper stack is cut to generate a center-bound booklet, the cutter unit comprising:

a fixed blade that extends along a direction orthogonal to a conveyance direction of the recorded paper when mounted to the paper processing apparatus; and a round blade that is disposed facing the fixed blade and rotates while moving in the direction in which the fixed blade extends, wherein the round blade cuts the end of the paper stack by rotating while moving in the direction orthogonal to the conveyance direction of the recorded paper.

28. The cutting unit as claimed in claim 27, wherein the cutting unit is configured so as to be able to be accommodated vertically above a compilation tray on which is stacked the recorded paper disposed at the paper processing apparatus with respect to the paper processing apparatus.

29. The cutting unit as claimed in claim 27, further comprising:

a moving mechanism for moving the round blade in the direction in which the fixed blade extends; and a rotating mechanism for rotating the round blade in accordance with the movement of the round blade by the moving mechanism.

* * * * *